US006748601B2

(12) United States Patent
LaShoto et al.

(10) Patent No.: US 6,748,601 B2
(45) Date of Patent: Jun. 15, 2004

(54) ARTICULATING BODY PROTECTIVE DEVICE

(76) Inventors: Henry G. LaShoto, 131 Doty St., Waltham, MA (US) 02452; Louis J. Foreman, 15735 Delancey La., Huntersville, NC (US) 28078

( * ) Notice: Subject to any disclaimer, the term of this patent is extended or adjusted under 35 U.S.C. 154(b) by 0 days.

(21) Appl. No.: 10/095,234

(22) Filed: Mar. 11, 2002

(65) Prior Publication Data

US 2003/0167560 A1 Sep. 11, 2003

(51) Int. Cl.[7] ..... A41D 13/00
(52) U.S. Cl. ..... 2/102
(58) Field of Search ..... 2/462, 463–465, 2/455, 456, 467, 247, 102, 44, 45, 267, 268, 908, 2.5; 128/878, 879; 602/6–8, 19, 20, 21, 64

(56) References Cited

U.S. PATENT DOCUMENTS 3,829,899 A * 8/1974 Davis ..... 2/2.5
4,441,211 A * 4/1984 Donzis ..... 2/459
4,507,801 A * 4/1985 Kavanagh et al. ..... 2/462
4,947,867 A * 8/1990 Keeton ..... 128/846
5,325,537 A * 7/1994 Marion ..... 2/462
5,465,424 A * 11/1995 Cudney et al. ..... 2/462
5,524,641 A * 6/1996 Battaglia ..... 128/846
5,675,844 A * 10/1997 Guyton et al. ..... 2/455
5,733,249 A * 3/1998 Katzin et al. ..... 602/21
5,771,489 A * 6/1998 Snedeker ..... 2/2.5
5,915,528 A * 6/1999 Shmuelov ..... 2/2.5
5,996,115 A * 12/1999 Mazelsky ..... 2/2.5
6,145,134 A * 11/2000 Davis et al. ..... 2/463
6,519,781 B1 * 2/2003 Berns ..... 2/267

* cited by examiner

*Primary Examiner*—Tejash Patel
(74) *Attorney, Agent, or Firm*—Glasgow Law Firm PLLC

(57) ABSTRACT

An articulating body protective device for protection from impact-based injuries, especially relating to sports activities, is provided by a composite body protector having a fabric outer garment and protective elements, in particular soft elements and semi-rigid and rigid elements, that are selectively provided in predetermined locations within the outer garment for protecting vital organs and other body parts from injuries related to impact during sports or athletic activities.

17 Claims, 6 Drawing Sheets

ARTICULATING BODY PROTECTIVE DEVICE

BACKGROUND OF THE INVENTION (1) Field of the Invention

The present invention relates generally to protective body wear and, more particularly, to an articulating body protective device for protection from impact-based injuries, especially relating to sports and playground activities.

(2) Description of the Prior Art

Typically, it is known to provide protective equipment for players in sports activities, especially where the sport involved high impact or the risk of injury from projectiles or bodily contact.

Prior art protective equipment commonly employs a hard shell that is strapped to the body, e.g., soccer shin guards, helmets, and the like, or a soft, padded covering that is worn as a garment over clothing, e.g., baseball catcher's padded vests, knee and elbow pads for volleyball and basketball, and the like. However, the protective equipment of prior art does not provide adequate protection from high impact, in particular from projectiles that may incidentally and inadvertently strike a body portion that is not typically covered with adequate protective equipment, e.g., the chest and heart region, the throat and neck region, etc., depending upon the sport. Also, the protective equipment is often bulky, uncomfortable, and does not adequately disperse energy.

Many prior art devices for protecting sports players from impacts do not provide adequate protection for vital organs from blunt trauma forces, in particular from projectiles as in baseball, softball, lacrosse, hockey, and the like. Vital organs like the heart, spinal cord, pancreas, kidneys, spleen, lungs, etc. and surrounding tissues in the chest, neck, torso, ribs, and other critical regions are particularly vulnerable to injuries due to impacts from such forces. More particularly, the condition of commotio cordis, or cardiac concussion, which is an arrhythmia or sudden death from a low-impact, blunt trauma to the chest without apparent heart injury, i.e., the impact to the chest stops the heart and results in deaths every year, is a serious concern, especially for children. Survival rates are low, even after resuscitation efforts. It is estimated that there are about ten deaths due to commotio cordis each year due to baseball-related impacts alone. Preventive measures are primarily offered from chest protective devices.

Data from the US Consumer Product Safety Commission and the National Injury Information Clearinghouse from 1998 reported that injuries requiring hospital emergency room visits from baseball included estimated totals of more than 4,200 upper trunk injuries, 4,600 lower trunk injuries, 1,300 neck injuries, 8,200 mouth injuries, 8,200 shoulder injuries, 17,900 head injuries, 42,000 face injuries, and 2,600 eye injuries; similarly, from the same report for 2000, there were reported more than a total of 182,000 injuries, including 5,100 upper trunk injuries, 5,200 lower trunk injuries, 8,800 shoulder injuries, 18,100 head injuries, 39,000 face injuries, and 3,400 eye injuries. Furthermore, in 2000, basketball injuries totaled more than 600,000; boxing, more than 13,000; football, nearly 400,000, hockey, ice hockey, street hockey and field hockey, more than 69,400; soccer, more than 185,000; lacrosse, more than 7,400; sledding, more than 38,000; and gas, air or spring-operated guns, as in paint ball, more than 17,000. Overall, sporting-related injuries that required hospital emergency room visits were estimated to be more than 3.4 million in 2000, according to these statistics. These figures do riot include visits to private physicians or other medical care providers.

By way of example, applicant's son, James Patrick LaShoto, was struck by a foul ball in the on-deck circle during a little league baseball game for 8–10 year olds in Waltham, Mass. in May 2001, which resulted in a 5-inch diameter bruise on his stomach for more than one month. He had little time, if any, to react in order to move out of the way or protect himself from being hit. Also, he was playing second base in baseball in June 2001 when he was struck by a baseball in the face, in particular the eye region. Fortunately, he was wearing virtually shatterproof polycarbonate sunglasses for protection, which likely prevented a permanent injury or blindness in his right eye. Thus, by way of real-life case-in-point, the use of protective devices for sports participants, especially for children, is valuable.

However, most effective impact-resistant protective devices are cumbersome, heavy, or hot and may restrict movement, which may discourage sports players or participants and spectators alike from wearing adequate protection to prevent injury in the event of projectile or other direct impact.

Thus, there remains a need for an articulating protective device that permits freedom of movement and breathability during athletic activity while offering protection from injurious impact from projectiles or direct impacts to the body, in particular areas including vital organs.

SUMMARY OF THE INVENTION

The present invention is directed to an articulating body protective device for protection from impact-based injuries, especially relating to sports activities.

The present invention is directed to an articulating protective device having a fabric outer garment enclosing rigid composite elements or shields that are premolded or custom-fit to conform to the shape of the user's body region that is to be protected by the device.

One aspect of the present invention is to provide an articulating protective device for players of sports including a fabric-based covering encasing composite elements and that is premolded or custom-fit to the user, is lightweight, and that presents a low profile so as not to inhibit freedom of movement of the user during athletic activities.

Another aspect of the present invention is to provide an articulating protective device for players of sports including a fabric-based covering that includes selectively removable composite elements and that is premolded or custom-fit to the user, is lightweight, and that presents a low profile so as not to inhibit freedom of movement of the user during athletic activities.

Basically, one advantage of the invention is that by having a pad in close intimate contact with the body, in particular, from the compression of the garment, wherein the better fit provides improved impact dispersion of blunt trauma forces. This occurs because more of the protective pad is in contact with the body reducing point loading and allowing superior impact dispersion. When compared to traditional pad systems that simply "hang" from the body, the compression garment provides a superior "fit" of the pads equals superior protection.

These and other aspects of the present invention will become apparent to those skilled in the art after a reading of the following description of the preferred embodiment when considered with the drawings.

DETAILED DESCRIPTION OF THE INVENTION

Figure 1:
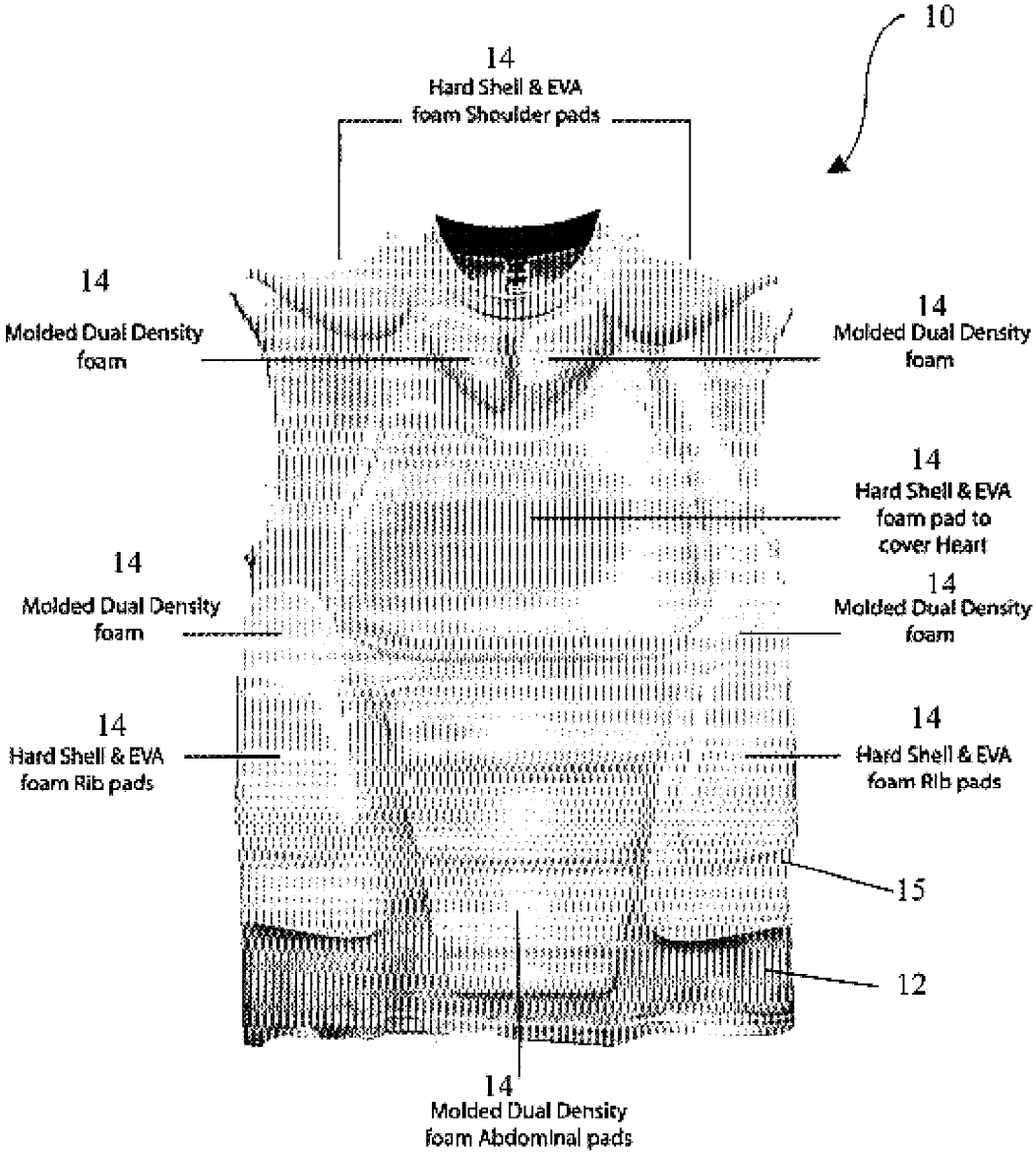
FIG. 1 is a front view of an articulating body protective device constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto. The present invention provides for an articulating protective device that is formed by a substantially flexible outer garment and protective elements, in particular soft elements and rigid elements, that are selectively provided in predetermined locations within the outer garment for protecting vital organs and other body parts from injury related to impact during sports or athletic activities. The elements combine to form an overall composite shield, which is collectively provided by the either rigid elements or soft elements, depending upon the level of impact resistant and/or energy absorption desired. The elements are insertable into the garment either during manufacturing, or by the user prior to use of the protective device. In a preferred embodiment, the elements are selectively removable, and may be inserted into pockets within the garment or attached by fasteners, e.g., hook and loop type fasteners, snaps, buttons, hooks and eyes, and the like. In another embodiment, the elements are fixed, in particular to ensure that the best and most complete protection possible from all elements is provided and cannot be tampered with.

The outer garment may be sized to cover the entire body or selected regions of the body of the user, or even select body parts only, including but not limited to sizing, shaping, and configuring the garment and associated elements for a chest protector, a torso and torso-region vital organ protector, a neck protector, a head and or face protector, and protection for the arms, shoulders, elbows, wrists, hands, legs, hips, knees, shins, calves, ankles, genitals, etc.

Figure 2:
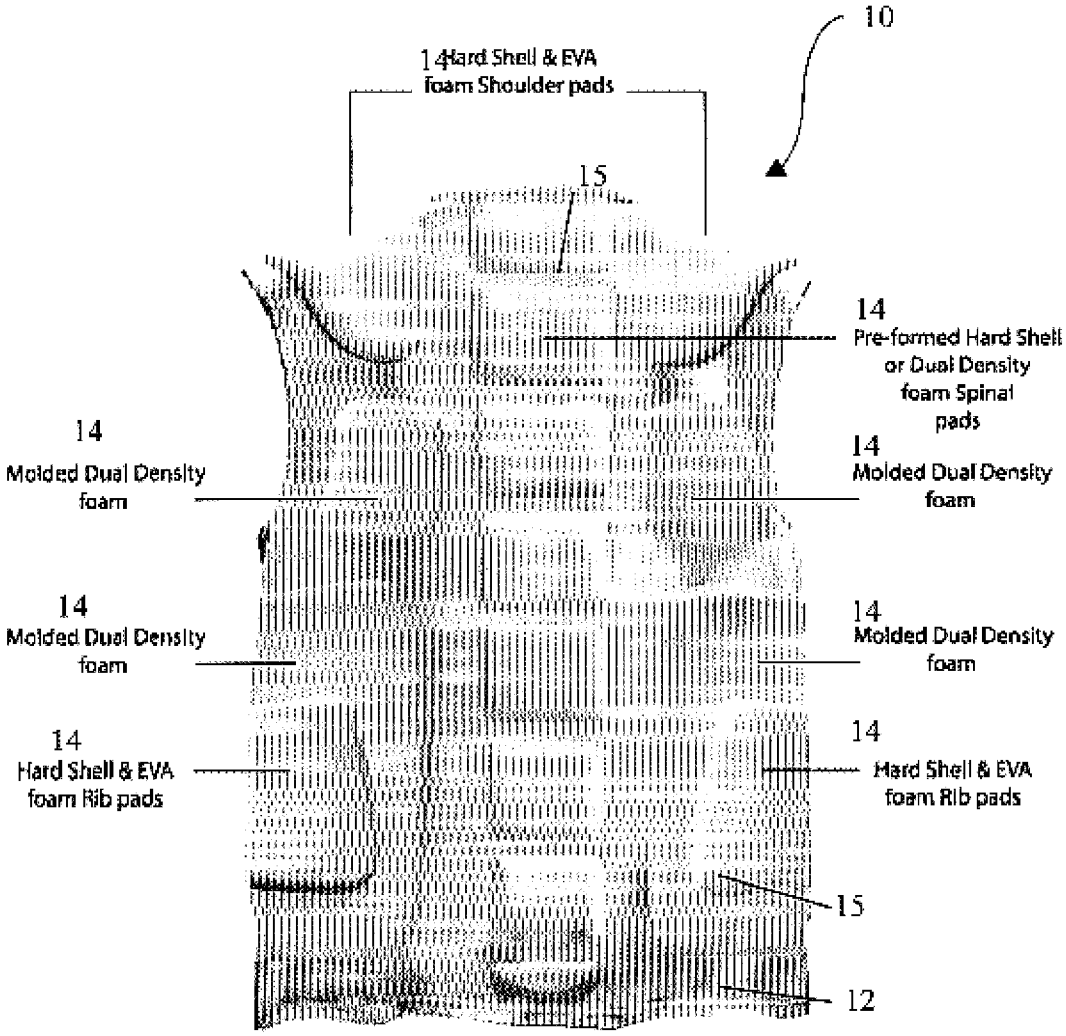
FIG. 2 is a back view of the embodiment shown in FIG. 1.
Figure 3:
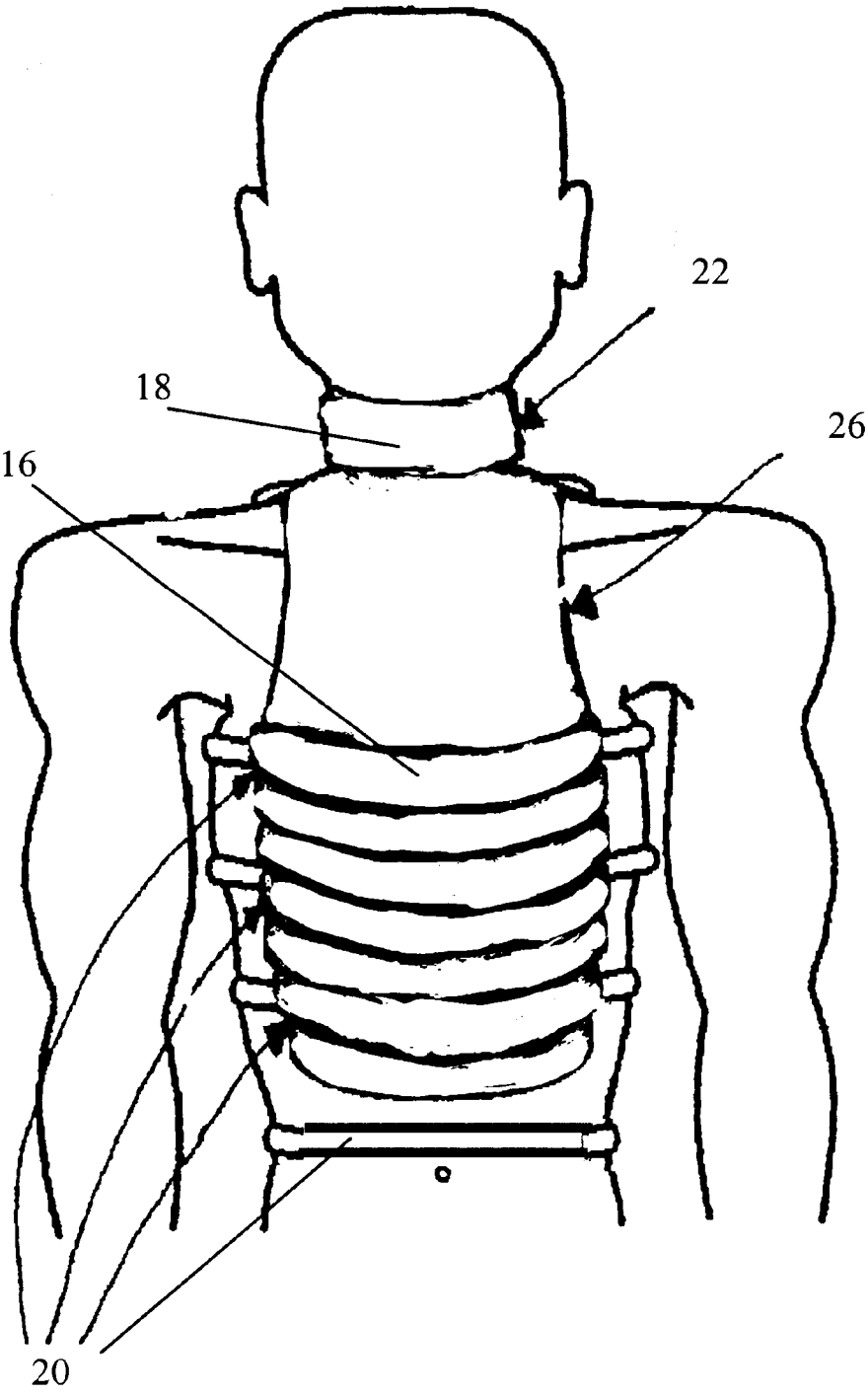
FIG. 3 is a front view of an alternative embodiment of the present invention.
Figure 4:
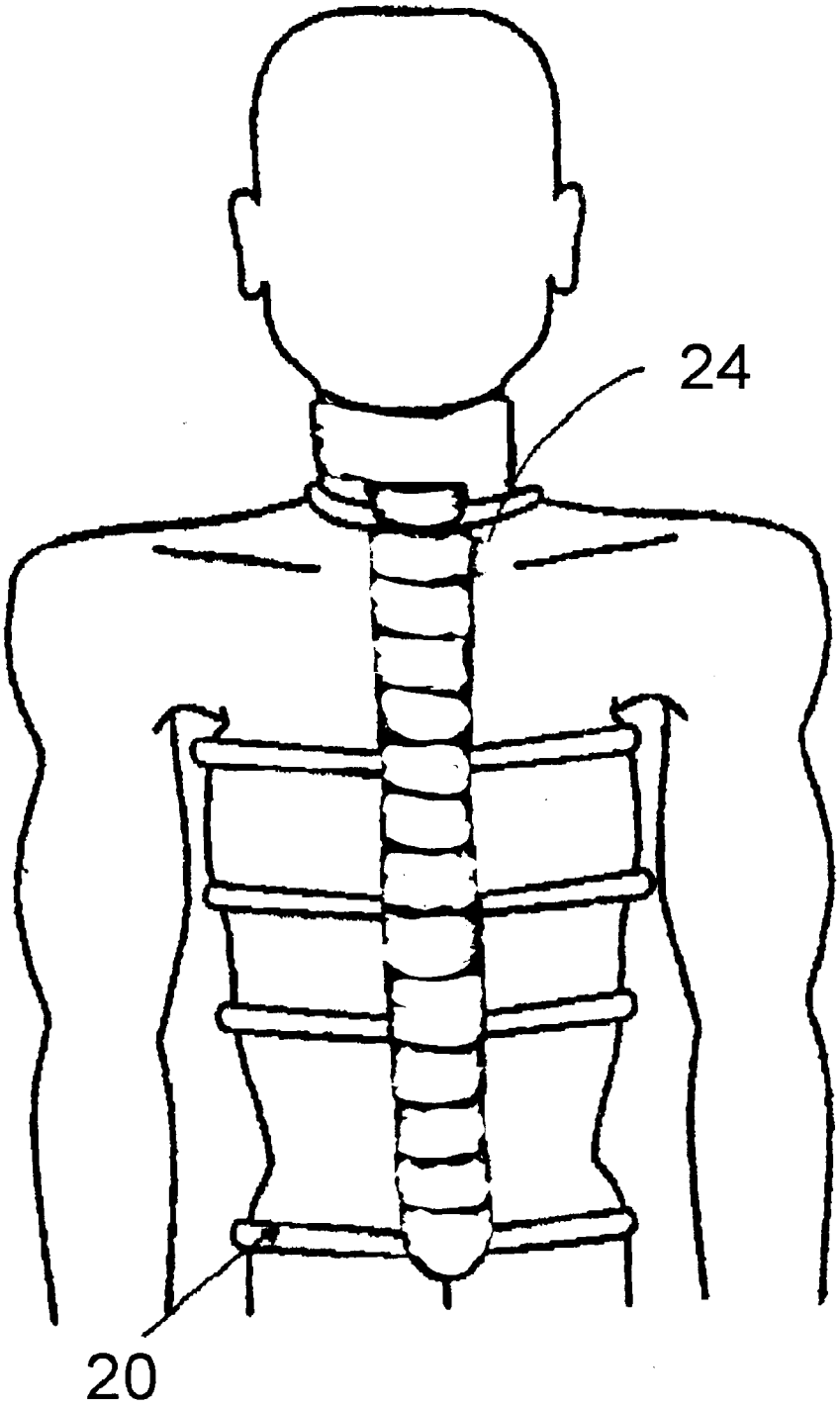
FIG. 4 is a back view of the embodiment shown in FIG. 3.

One embodiment of the present invention, shown in FIGS. 1 and 2, include an articulating protective device, generally referenced 10, including a fabric outer garment 12 and protective elements 14, in particular soft elements and rigid elements, that are selectively provided in predetermined locations within the outer garment and housed within pockets 15 in the garment for protecting vital organs and other body parts from injury related to impact during sports or athletic activities. Another embodiment is shown in FIGS. 3 and 4, wherein the fabric outer garment covers the body primarily in the chest and torso region 16, as well as the neck area 18. Connective webbing 20 is provided around the sides and underarm areas to provide for increased freedom of movement and breathability, while still providing protection over the critical organ regions. An articulating collar 22 is also shown. Cup-shaped disks 24 are used for the spine protection in FIG. 4, while the chest protection is provided by a unitary, larger element 26 in FIG. 3.

The semi-rigid and rigid elements are composite elements formed of fabric elements, in particular woven, knitted, or braided fabrics, either in single or multiple layers are used; preferably, 3D engineered fiber preforms or fabrics are used, which are formed by a 3D fabric-forming method selected from the group consisting of 3D weaving, 3D braiding, 3D circular weaving, and multiaxial weaving. Alternatively, plastic, injection-molded pieces are used for the semi-rigid and rigid elements in another embodiment according to the present invention. In particular, true 3D weaving involving three orthogonal, non-interlacing yarn systems are preferred; such true 3D woven constructions are formed by the methods set forth in U.S. Pat. No. 5,085,252 issued Feb. 4, 1992 to Mohamed, et al. for METHOD OF FORMING VARIABLE CROSS-SECTIONAL SHAPED THREE-DIMENSIONAL FABRICS which is incorporated herein by reference in its entirety. Also, U.S. Pat. No. 5,465,760 issued Nov. 14, 1995 to Mohamed, et al. for MULTILAYER THREE-DIMENSIONAL FABRIC AND METHOD FOR PRODUCING is also incorporated herein by reference in its entirety. Elements to protect different organs or regions may be formed from different fabric-forming methods, such that the overall protective device may include a variety of element types or homogeneous elements. These composite elements are preferably formed of pre-shaped components including shells or sheaths of 3D engineered materials that are infused with resin, e.g., vinylester, for providing additional stiffness, strength, and/or impact-resistance.

The outer garment may be fabricated using a close-fitting material, preferably one with at least some memory so that the user's general body shape is maintained during use and is retained during subsequent uses. Also, breathable material is preferred so that the user is not uncomfortable due to extra heat induced by the garment during wear and activity. It is preferred that the material be cleanable, more preferably washable, since use during athletic activity would likely soil the garment. Additionally, a protective, soil-resistant coating may be applied. The outer garment preferably includes materials having breathability, such as COOLMAX fabric, which is commercially available by DuPont. Another commercially available breathable polypropylene fabric that is tight fitting is commercially available by Under Armor. Other similar or equivalent materials are considered to be applicable and within the scope of the present invention.

The elements may be pre-shaped or pre-molded. The elements include both premolded foam padded elements and rigid, composite elements. The premolded foam padded elements offer soft protection for the fleshy areas of the body, in particular for non-vital organs in the abdominal region. The heart and other vital organs are protected with rigid, composite elements that are molded into the garment in order to offer close and comfortable fitting of the protective device.

Also, these composite elements may be custom-fitted and molded into the garment; alternatively, these may be removable, e.g., for washing or cleaning the garment. Additionally, these elements may be removable in order to provide the user with selective protection, depending upon the level of protection and risk associated with the particular sports activity. A custom-fitted version is considered to be the best mode of the invention, in order to provide the optimal level of protection and freedom of movement or overall performance of the protective device according to the present invention. In one embodiment, where a custom-fitted garment includes 3D engineered fiber structures that are preformed to a near net shape element or formed, cut, and approximately shaped to a predetermined sized element, depending upon the body part or region to be protected, the element is treated with a resin that is either moisture- or temperature-curable, such that exposure to either moisture or higher than body temperature, respectively, provides for activation and setting of the resin in order to form a rigid composite element. In an alternative embodiment, the outer garment can be purchased to fit an approximate body size and shape, e.g., extra-small, small, medium, large, extra-large, etc. and may be provided for either male or female body types or for unisex shaping. The padded elements and rigid composite elements are provided separately such that they may be selectively inserted and removable from the outer garment. In a preferred embodiment, pockets are provided for maintaining the elements in an approximate position to protect the body parts and organs; in another embodiment, attachment means or fasteners such as hook and loop type fasteners, e.g., VELCRO, are provided to ensure releasable attachment with the garment during use. The preforms used for the composite elements are manufactured from engineered fibers, in particular synthetic fibers, and including but not limited to KEVLAR, fiberglass, carbon, nylon, and combinations thereof. The padded elements are preferably manufactured from a resilient material, such as foams, including molded dual density foam, polyurethane, neoprene, and EVA foams. Preferably, the foam is selected from EVA or polyurethane foams, or foam alternatives, or other comfort liner materials. Foam alternatives may include materials such as SKYDEX padding, which is commercially provided by Skydex, and which provides for improved durability for washing and cleaning when compared with many foams, as well as improved performance and impact resistance, and it maintains its energy absorbing and/or energy dispersing qualities, while not absorbing moisture. Perforations in such foams are desirable in order to ensure some breathability of the overall protective wear in those areas having the soft padded elements. Another breathable foam or foam alternative material that may be used with the present invention is SPACENET, which is commercially provided by Spacenet.

The overall protective device, including the outer garment and the protective elements, both soft padded and rigid composite elements, are preferably custom-fitted to the user, are lightweight, and present a low profile so as not to inhibit freedom of movement of the user during athletic activities. As set forth hereinabove, the elements may be initially flexible with later hardening after conforming substantially to the user's body shape and size, or the elements may be partially flexible and partially rigid, thereby forming an articulated protective device when connected with the outer garment. These elements may be joined by the outer garment itself, or they may alternatively or additionally be joined by webbing or other connective means, including jointing, stretch webbing, hook and loop type fasteners such as VELCRO fasteners, or they may be overlapped or hinged, preferably by synthetic or plastic connectors. The joined or jointed elements act as discrete protective components and can move relative to each other, thereby providing freedom of movement required for sports activities while providing protection for the body parts covered with the device and its elements. Furthermore, the elements may be disc-shaped components or substantially body part-shaped components in order to provide the optimal coverage and moveability for the user.

Figure 5:
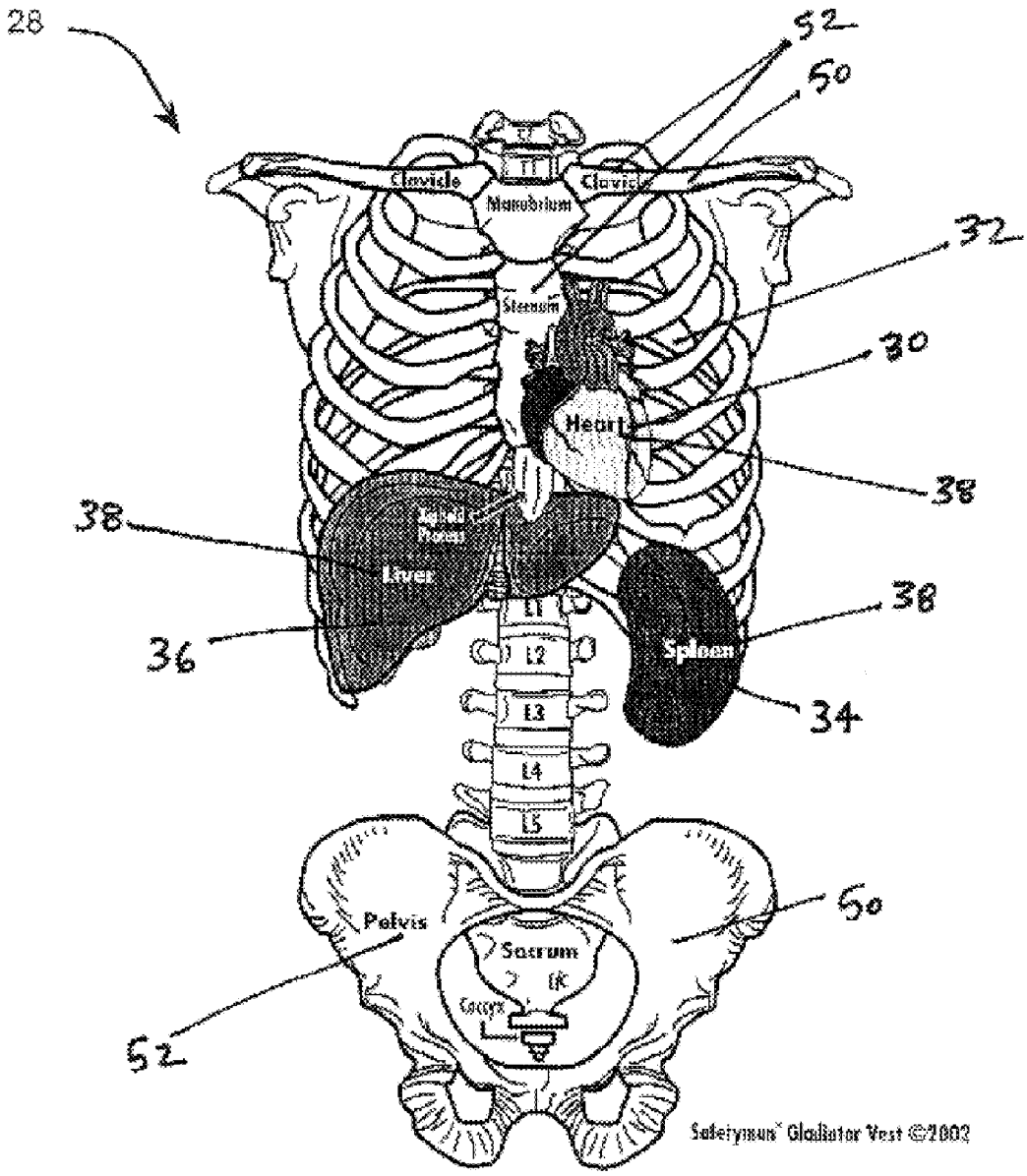
FIG. 5 is a front view of labeling provided for the front side of the device according to the present invention.
Figure 6:
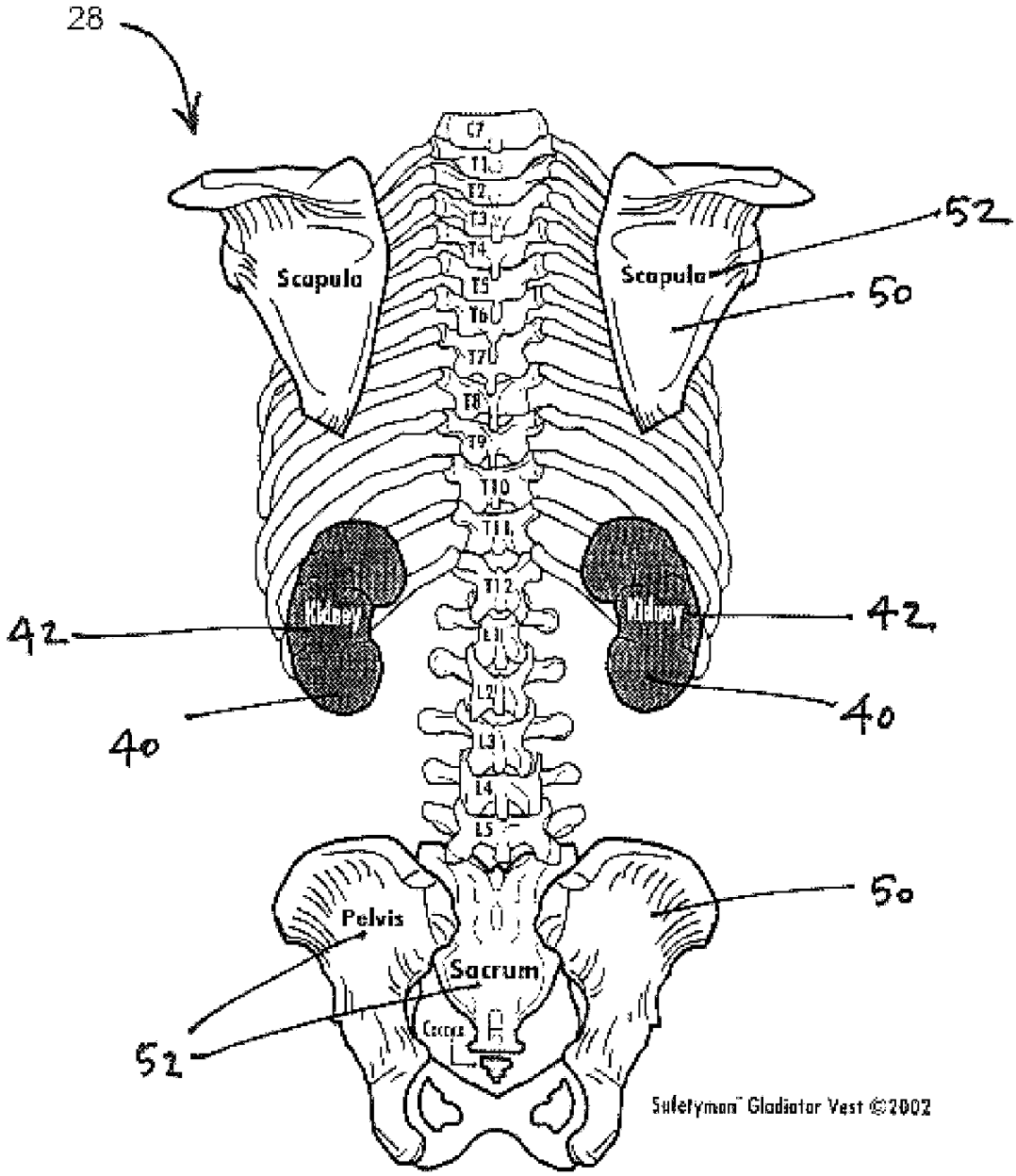
FIG. 6 is a back view of labeling provided for the back side of the device according to the present invention.

FIGS. 5 and 6 illustrate the front and back sides, respectively, of labeling, generally referenced 28, that may advantageously and functionally be employed with the present invention to indicate which of the elements, both rigid composite and soft padded elements, and their corresponding locations are associated with protection of particular internal organs and body parts. The labeling preferably includes illustrations of internal organs, e.g., in FIG. 5, heart 30, lungs 32, spleen 34, liver 36, and respective word labels for each 38, and in FIG. 6, kidneys 40 and respective word labels for them 42 as well as body parts, in particular, bones 50 and respective word labels for each 52. The labeling may be directly on the outer garment, as applied or attached by imprinting, silk screening, painting, heat transferring, coating, adhesives, and the like. Alternatively, the labeling may be attached or printed on a t-shirt that would be worn overtop the vest. The labeling is useful for assisting the user, especially children, in identifying which of the protective elements are important for protection while playing a given sport. Where removable elements, in particular soft padded elements, are selectively removable, the labeling, including both the illustrations and the word labels, provide a visual aid to correctly re-inserting the elements where they belong; the padded elements may also be matchingly and correspondingly labeled with the labeling to further aid the reinsertion into the pockets of the outer garment.

Overall, one advantage of the invention is that by having a pad in close intimate contact with the body, in particular, from the compression of the garment, wherein the better fit provides improved impact dispersion of blunt trauma forces. This occurs because more of the protective pad is in contact with the body reducing point loading and allowing impact dispersion. When compared to traditional pad systems that simply "hang" from the body, the compression garment provides a superior "fit" of the pads equals superior protection.

A significant advantage is provided by the use of three-dimensional (3D) materials such as those supplied commercially by 3TEX, Inc. of Cary, N.C., in that the materials provide a decrease of about 20% in the force transferred to the body, with approximately a 20% lighter weight compared to traditional materials, e.g., ABS plastic listed in Table 1 below. Test results as measured by an independent drop test device, which simulates impacts and records energy dispersing properties of the materials tested, show the following data for the present invention when compared with the prior art. The following test results of Table 1 illustrate the advantages of the use of the 3D materials when compared with traditional materials used in other protective device applications:

TABLE 1

ABS plastic v. 3TEX Composite Impact Research Study

| Location | Anvil Material Impact Date | ABS Aug. 7, 2001 | Carbon/ Kevlar Aug. 7, 2001 | FG/Poly Red/Blue Aug. 7, 2001 | E-Glass Red Aug. 7, 2001 | Hybrid 28 Sep. 18, 2001 | Hybrid 29 Sep. 18, 2001 |
|---|---|---|---|---|---|---|---|
| | | | | Flat | | | |
| 0 | Front | 256.4 | 242.8 | 251.9 | 249.6 | 235.0 | 247.3 |
| 45 | Front Right | | | | | | |
| 90 | Right | | | | | | |
| 135 | Rear Right | | | | | | |
| 180 | Rear | 234.6 | 255.5 | 238.2 | 240.0 | 222.7 | 217.7 |
| 225 | Rear Left | | | | | | |
| 270 | Left | | | | | | |
| 315 | Front Left | | | | | | |
| 0 | Front | | | | | 242.8 | 238.7 |
| 45 | Front Right | | | | | | |
| 90 | Right | | | | | | |
| 135 | Rear Right | | | | | | |
| 180 | Rear | | | | | 213.2 | 206.8 |
| 225 | Rear Left | | | | | | |
| 270 | Left | | | | | | |
| 315 | Front Left | | | | | | |
| | | | | Hemi | | | |
| 0 | Front | | | | | | |
| 45 | Front Right | | | | | | |
| 90 | Right | 161.2 | 160.8 | 168.5 | 157.6 | 143.5 | 150.3 |
| 135 | Rear Right | | | | | | |
| 180 | Rear | | | | | | |
| 225 | Rear Left | | | | | | |
| 270 | Left | | | | | | |
| 315 | Front Left | | | | | | |
| 0 | Front | | | | | | |
| 45 | Front Right | | | | | | |
| 90 | Right | | | | | 146.2 | 144.4 |
| 135 | Rear Right | | | | | | |
| 180 | Rear | | | | | | |
| 225 | Rear Left | | | | | | |
| 270 | Left | | | | | | |
| 315 | Front Left | | | | | | |
| | | | | Edge | | | |
| 0 | Front | | | | | | |
| 45 | Front Right | | | | | | |
| 90 | Right | | | | | | |
| 135 | Rear Right | | | | | | |
| 180 | Rear | | | | | | |
| 225 | Rear Left | | | | | | |
| 270 | Left | 139.4 | 130.3 | 136.6 | 134.4 | 136.6 | 125.7 |
| 315 | Front Left | | | | | | |
| 0 | Front | | | | | | |
| 45 | Front Right | | | | | | |
| 90 | Right | | | | | | |
| 135 | Front Right | | | | | | |
| 180 | Rear | | | | | | |
| 225 | Rear Left | | | | | | |
| 270 | Left | | | | | 130.3 | 114.3 |
| 315 | Front Left | | | | | | |

Certain modifications and improvements will occur to those skilled in the art upon a reading of the foregoing description and research results. By way of example, substitute three-dimensional (3D) materials, including other resin-infused materials may be used; other energy dispersing foams in combination with the 3D resin infused materials may be used; and other breathable and/or tight fitting garments may be used without departing from the scope of the present invention. Also, other body parts or protective components of the device may be employed, such as a neck guard made of 3D resin infused material or polycarbonate designed to hang from a helmet or face cage and articulate with the vest to provide maximum protection and flexibility. Also, a genital guard made of 3D resin infused material may be designed to articulate with the vest. Furthermore, different artwork, such as the name of a sponsor or a team may be silk-screened and then heat transferred onto the device for marketing and advertising attractiveness.

All modifications and improvements have been deleted herein for the sake of conciseness and readability but are properly within the scope of the following claims.

We claim:

1. An articulating protective vest for providing protection from injuries to a user comprising:

a substantially flexible outer premolded garment for the user further including distinct, separate protective elements that are provided in predetermined locations within the outer garment and positioned in an articulating jointed manner with respect to proximal protective elements and selectively removable from the vest to provide impact-resistance from objects, which provides protection of vital organs from injuries related to impact during sports or athletic activities or other activities requiring personal body protection.

2. The device according to claim 1, wherein the protective elements are soft elements and rigid elements.

3. The device according to claim 1, wherein the elements are selectively removable.

4. The device according to claim 1, wherein the elements are fixedly attached to the outer garment.

5. The device according to claim 1, wherein the elements are secured in pockets in the outer garment.

6. The device according to claim 2, wherein the rigid elements are formed of three-dimensional engineered materials.

7. The device according to claim 6, wherein the three-dimensional engineered materials are 3D woven fabrics.

8. The device according to claim 7, wherein the 3D woven fabrics are further treated with a resinous substance to create rigid composite elements.

9. The device according to claim 6, wherein the three-dimensional engineered materials include high-performance synthetic fibers selected from the group consisting of KEVLAR, fiberglass, carbon, nylon, and combinations thereof.

10. The device according to claim 2, wherein the soft elements are formed of foam-like material.

11. The device according to claim 10, wherein the foam-like material is a foam, selected from the group consisting of molded dual density foam, polyurethane, neoprene, and EVA foams.

12. The device according to claim 1, wherein the elements are preformed to a similar shape as the body parts for which they provide protection.

13. The device according to claim 1, wherein the elements are custom-fit to the individual who will be wearing the device.

14. The device according to claim 1, wherein the elements are custom-molded.

15. The device according to claim 1, wherein the outer garment includes a labeling for indicating corresponding locations associated with protection of particular internal organs and body parts that are protected by the device.

16. The device according to claim 15, wherein the labeling is directly on the outer garment.

17. The device according to claim 16, wherein the labeling is affixed to the outer garment by a method selected from the group consisting of imprinting, silk screening, heat transfering, painting, coating, adhesives, and combinations thereof.

* * * * *